US006168257B1

(12) United States Patent
Aldrich

(10) Patent No.: US 6,168,257 B1
(45) Date of Patent: Jan. 2, 2001

(54) MAINTENANCE STATION FOR AN INK CARTRIDGE FOR A PRINTER

(75) Inventor: Charles Stanley Aldrich, Nicholasville, KY (US)

(73) Assignee: Lexmark International, Inc., Lexington, KY (US)

( * ) Notice: Under 35 U.S.C. 154(b), the term of this patent shall be extended for 0 days.

(21) Appl. No.: 08/989,153

(22) Filed: Dec. 12, 1997

(51) Int. Cl.[7] ..... B41J 2/165
(52) U.S. Cl. ..... 347/32
(58) Field of Search ..... 347/32, 33, 24

(56) References Cited

U.S. PATENT DOCUMENTS 5,440,331 * 8/1995 Grange ..... 347/32
5,517,219 * 5/1996 Uchida ..... 347/24
5,570,117 * 10/1996 Karambelas et al. ..... 347/32

FOREIGN PATENT DOCUMENTS 297 16 190 U 11/1997 (DE) .
0 604 067 6/1994 (EP) .
0 604 068 6/1994 (EP) .
0 720 912 7/1996 (EP) .
WO 96/34754 11/1996 (WO) ..... B41J/2/165

* cited by examiner

*Primary Examiner*—John Barlow
*Assistant Examiner*—Charles Stewart
(74) *Attorney, Agent, or Firm*—Jacqueline M. Daspit; Ronald K. Aust

(57) ABSTRACT

An ink jet printer has a maintenance station in which a movable sled starts from a known position due to a diagonally disposed return spring. A cam profile near the uppermost portion of vertical movement of a movable sled is produced in accordance with a quadratic equation. This quadratic designed equation profile reduces the force required to move the movable sled up the cam profile to its uppermost position. The return spring, which holds the movable sled in the known position by urging a front wall of the movable sled against a front wall of a support housing, also absorbs energy to decrease the noise level of the printer.

4 Claims, 8 Drawing Sheets

MAINTENANCE STATION FOR AN INK CARTRIDGE FOR A PRINTER

FIELD OF THE INVENTION

This invention relates to an improved maintenance or service station for an ink cartridge of a printer and, more particularly, to an improved maintenance or service station for an ink cartridge of a printer having a portion of its cam surfaces formed with an unique profile and an unique spring arrangement.

BACKGROUND OF THE INVENTION

U.S. Pat. No. 5,440,331 to Grange discloses a service or maintenance station for an ink cartridge of an ink jet printer. Wiping of the print head of an ink cartridge by wipers on a movable sled occurs at a first elevation to which the movable sled is raised from its lowermost position and capping of the print heads of the ink cartridges occurs at a second and higher elevation of the movable sled. The movable sled is supported in a fixed base having cam surfaces for cooperating with cam followers on the sled to raise and lower the sled.

The cam profiles of the cams are straight line surfaces. These create a need for a relatively large motor, which is driving the carrier, because of the varying forces applied by motion of the sled, which is driven by the carrier, along the cam profiles to its uppermost position.

While the aforesaid Grange patent returns the sled to its lowermost position solely by engagement of the carrier with the sled so as to require a relatively large amount of power, it has been previously suggested to return the sled to its lowermost position through the use of a return spring. This return spring applies a force solely in the direction of longitudinal movement of the movable sled. The return spring reduces the power utilized in comparison with the maintenance or service station of the aforesaid Grange patent. However, the return spring creates substantial noise in the printer when it biases the movable sled to its lowermost position because of engagement of the movable sled with its base.

SUMMARY OF THE INVENTION

The maintenance or service station of the present invention satisfactorily solves the foregoing problems. The maintenance or service station has the cam profile designed in accordance with a quadratic equation for the final portion of upward motion of the movable sled along each of the cams. This design of the cam profile reduces the required force to move the movable sled to its uppermost position, which is the position at which there is capping of the print heads on the ink cartridges, to a minimum and a constant. The required force during capping is greater than the force required to move the movable sled upwardly from its lowermost position. Therefore, the design of the final portion of the cam profile in accordance with a quadratic equation lowers power usage and enables a smaller motor to be employed for driving the carrier.

The noise level created by using the previously suggested return spring is decreased in the maintenance station of the present invention. This is accomplished by disposing the return spring so that its force is exerted at an angle to the longitudinal movement of the movable sled.

This diagonal positioning of the return spring produces a first component of the force along the longitudinal movement of the movable sled and a second component of the force perpendicular to the longitudinal movement of the movable sled. The second component of the force urges the front wall of the movable sled into engagement with the front wall of the support housing to create friction therebetween when the movable sled is returned to its lowermost position by the first component of the force of the return spring. This friction along with damping created by a viscous media on the front wall of the support housing absorbs the energy of the return spring. As a result, the left end of the movable sled does not engage the left end of the support housing with as large a force so that the noise level of the printer is reduced.

The second component of the force enables the return spring to also hold the movable sled at a known home position with respect to the support housing. That is, the return spring holds the front wall of the movable sled against the front wall of the support housing to provide the known home position. This enables more precise motion of the movable sled since it is always starting from the same fixed known home position rather than an approximate home position.

An object of this invention is to provide an improved maintenance station for use in maintaining or servicing an ink cartridge of an ink jet printer.

Another object of this invention is to provide a maintenance station having an uppermost portion of a cam profile designed in accordance with a quadratic equation to require a relatively constant minimum force for causing upward movement of a movable sled as it is moved longitudinally.

A further object of this invention is to provide a maintenance station having a return spring, which returns a movable sled to its home position, to produce a force to move the movable sled transversely to a fixed known home position and to have its energy absorbed to reduce the noise level of the printer.

Other objects of this invention will be readily perceived from the following description, claims, and drawings.

DETAILED DESCRIPTION OF PREFERRED EMBODIMENT

Figure 1:
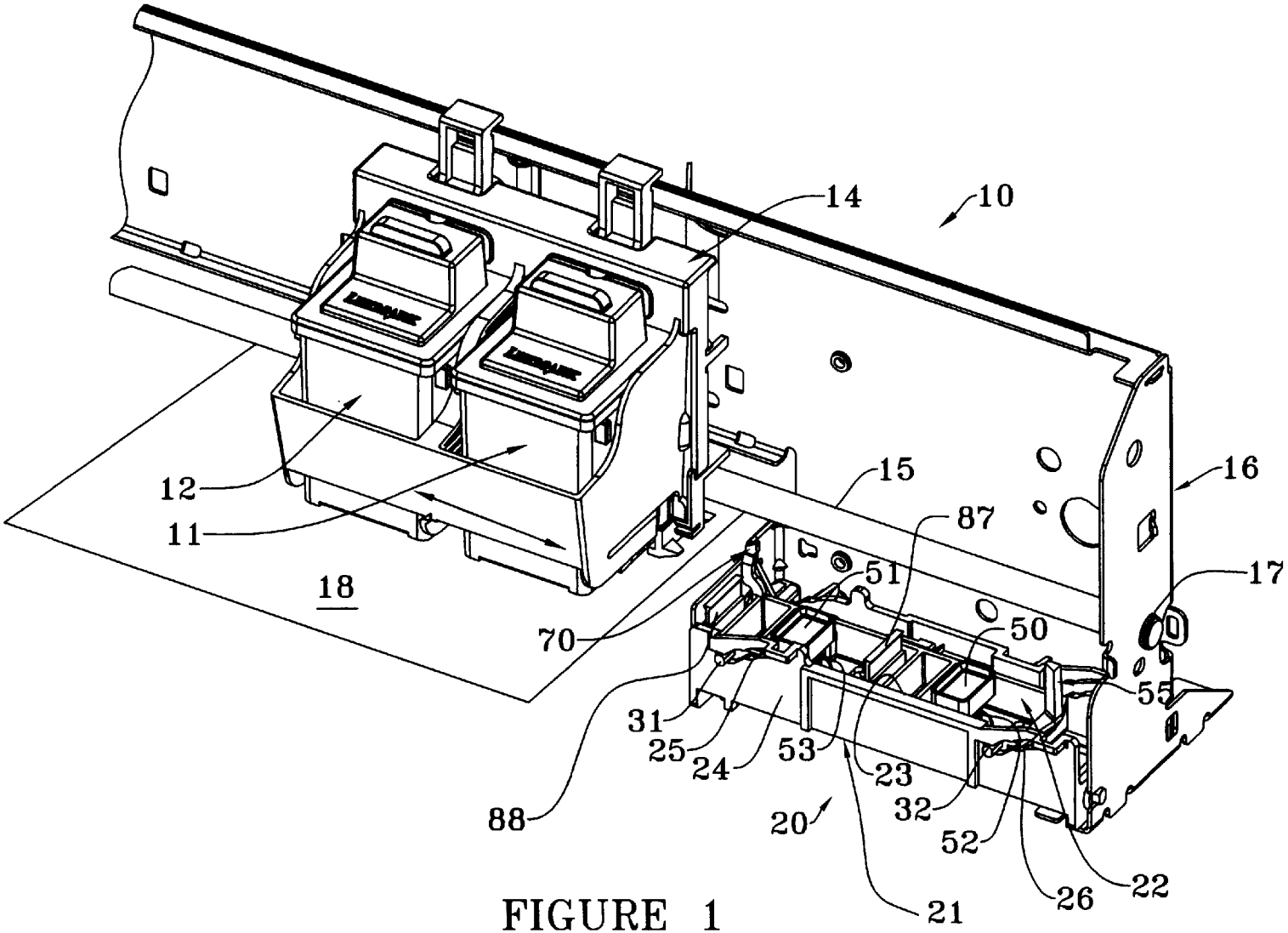
FIG. 1 is a perspective view of an ink jet printer having a maintenance station of the present invention.

Referring to the drawings and particularly FIG. 1, there is shown an ink jet printer 10 having a pair of removable ink cartridges 11 and 12 supported by a carrier 14. While two of the cartridges 11 and 12 have been shown, it should be understood that only one of the cartridges 11 and 12 may be employed or more than two of the cartridges 11 and 12 may be utilized. This would depend upon whether the ink jet printer 10 is capable of printing colors and black or just black.

The carrier 14 is driven longitudinally in opposite directions along a fixed shaft 15. The shaft 15 is supported in a fixed frame 16 as shown at end 17 of the shaft 15.

The carrier 14 is driven from a suitable power source in opposite directions. The power source is preferably a motor (not shown), a pulley (not shown) on a shaft of the motor, and a drive belt mechanism (not shown) connecting the pulley with the carrier 14 to cause the carrier 14 to slide along the shaft 15 in either longitudinal direction in response to rotation of the motor.

The ink cartridges 11 and 12 have print heads with nozzles to supply ink to print on a sheet 18 of paper media, for example, in the well-known manner. The sheet 18 may be any paper media.

The ink jet printer 10 includes a maintenance or service station 20 for cleaning the nozzles of the print head of each of the ink cartridges 11 and 12, ejecting ink from the nozzles, and capping the print heads when a printing cycle has been completed. Other services may also be performed if desired.

The maintenance station 20 includes a fixed support housing or base 21, which is fixed to the frame 16. A movable sled 22 is removably supported within a rectangular-shaped cavity 23 in the support housing 21 for both longitudinal and vertical movement therein.

Figure 2:
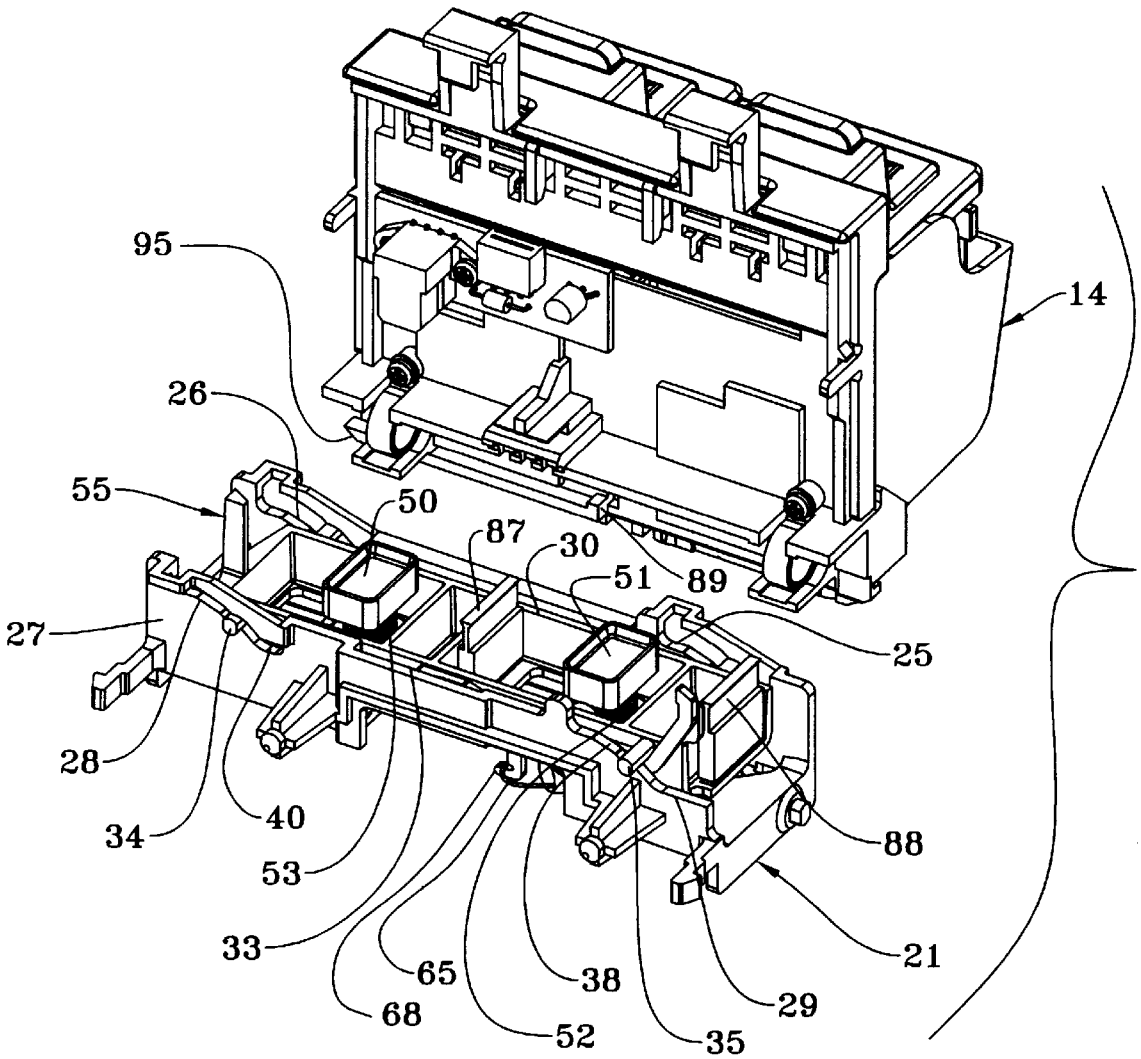
FIG. 2 is an exploded perspective view of the ink jet printer of FIG. 1 with the maintenance station separated from a carrier and taken from the rear of FIG. 1.

A front wall 24 of the support housing 21 has a pair of cam slots 25 and 26 therein at opposite ends thereof. Similarly, a back wall 27 (see FIG. 2) of the support housing 21 has a cam slot 28 and a cam surface 29 therein at opposite ends thereof. Thus, there is only the single cam slot 28 in the back wall 27 of the support housing 21.

A front wall 30 of the movable sled 22 has pins 31 (see FIG. 1) and 32 extending therefrom. The pin 31 is disposed in the cam slot 25, and the pin 32 is disposed in the cam slot 26.

Similarly, a back wall 33 (see FIG. 2) of the movable sled 22 has pins 34 and 35 extending therefrom. The pin 34 is disposed in the cam slot 28, and the pin 35 rides along the cam surface 29.

Accordingly, each of the pins 31 (see FIG. 1), 32, 34 (see FIG. 2), and 35 functions as a cam follower. The cam slot 25 (see FIG. 1), the cam slot 26, the cam slot 28 (see FIG. 2), and the cam surface 29 control vertical motion of the movable sled 22 during its longitudinal movement in both directions.

Each of the cam slot 25 (see FIG. 1), the cam slot 26, the cam slot 28 (see FIG. 2), and the cam surface 29 has a cam profile 38 (see FIG. 11) based on a cam profile 39. The cam profile 39 passes through the center of each of the pins 31 (see FIG. 1), 32, 34 (see FIG. 2), and 35.

Figure 11:
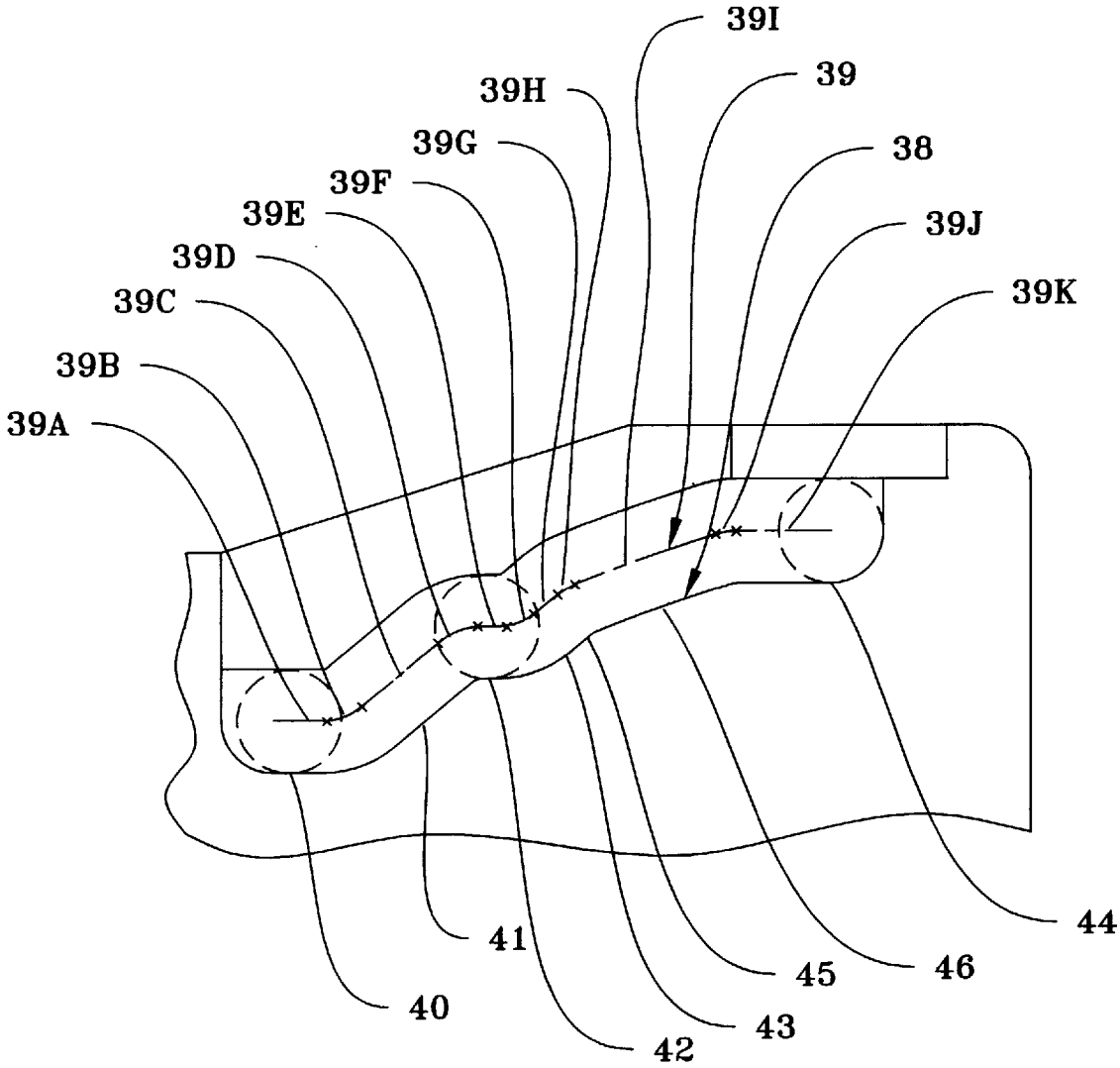
FIG. 11 is a schematic diagram of the portion of the cam profile formed by the quadratic equation to produce the minimum force necessary for movement of the movable sled to its uppermost position in the support housing.

As shown in FIG. 11, the cam profile 39 includes a low dwell 39A connected by a cycloidal transition 39B to a first or lower trapezoidal portion 39C, which is connected by a cycloidal transition 39D to an intermediate dwell 39E. A cycloidal transition 39F connects the intermediate dwell 39E to a second or upper trapezoidal portion 39G, which is connected by a cycloidal transition 39H to a quadratic portion 39I. The quadratic portion 39I is connected by a cycloidal transition 39J to an upper dwell 39K.

The cam profile 38 of each of the cam slot 25 (see FIG. 1), the cam slot 26, the cam slot 28 (see FIG. 2), and the cam surface 29 corresponds to the cam profile 39 (see FIG. 11), but it is shifted slightly from the cam profile 39. While the cam profile 38 has the cycloidal transitions of the cam profile 39, they will not be described or identified.

Thus, the cam profile 38 includes a low dwell 40, which is a substantially flat surface, on which each of the pins 31 (see FIG. 1), 32, 34 (see FIG. 2), and 35 rests when the sled 22 (see FIG. 1) is in its lowermost position of FIG. 1. The cam profile 38 (see FIG. 11) has a first or lower trapezoidal portion 41, which is a straight line, extending from the low dwell 40 to a second or intermediate dwell 42, which is a substantially flat surface.

The cam profile 38 has a second trapezoidal portion 43 extending from the intermediate dwell 42 towards an upper dwell 44. However, the second trapezoidal portion 43 of the cam profile 38 terminates prior to the upper dwell 44, which is a substantially flat surface. The cam profile 38 from a point 45 to the upper dwell 44 has a portion 46 formed in accordance with a quadratic equation to decrease the force required to move the sled 22 (see FIG. 1) upwardly therealong to a substantially constant minimum.

When the movable sled 22 is moved to the right by the carrier 14 engaging the movable sled 22, the pins 31, 32, 34 (see FIG. 2), and 35 ride up the cam profile 38 (see FIG. 11) to the upper dwell 44. When the point 45 of the cam profile 38 is reached, compression caps 50 (see FIG. 1) and 51 have begun to compress springs 52 and 53, respectively, because of engagement of the caps 50 and 51 with the print heads (not shown) of the ink cartridges 11 and 12, respectively.

As the springs 52 and 53 are compressed, the force required to continue to move the caps 50 and 51 upwardly into a sealing relation with the print heads (not shown) of the ink cartridges 11 and 12, respectively, increases. Each of the caps 50 and 51 has a sealing lip at its upper end in engagement with the print head (not shown) of each of the ink cartridges 11 and 12, respectively.

The magnitude of the force to move the compression caps 50 and 51 to their uppermost positions in which they rest on the upper dwell 44 (see FIG. 11) of the cam profile 38 is determined by the cam profile 38 from the point 45 to the upper dwell 44. It is desired that this force be maintained at a minimum since this force determines the maximum amount of power required by the motor (not shown) driving the carrier 14 (see FIG. 1).

The force F for imparting movement of the movable sled 22 to the right is dependent upon a cam pressure angle A and the vertical forces created by movement of the caps 50 and 51 to their sealing relation with the print head (not shown) of each of the ink cartridges 11 and 12, respectively. This relationship is defined by equation (1):

$$\text{tangent } A=F/F_c=dy/dx \quad (1).$$

It should be understood that the cam pressure angle A may not be constant so that the force F varies.

The cap force $F_c$ is defined by equation (2):

$$F_c=F_i+ky \quad (2)$$

where k is a constant, which is the spring rate of both of the springs 52 and 53, and y is the deflection of each of the springs 52 and 53.

To have the force F at a minimum for moving the movable sled 22 from its lowermost position to its uppermost position, the force F is set to a constant, and equations (1) and (2) combined and integrated to determine a profile of the cam profile portion 39I (see FIG. 11) having the variable cam pressure angle A. This results in the following quadratic profile for the cam profile portion 39I as defined by the quadratic equation:

$$x=(F_i/F)y+(Fk/2)y^2 \quad (3).$$

In equation (3), x represents a specific position in the x direction for a specific y position in the y direction or vice versa. This is how the quadratic profile for the cam profile portion 39I of the cam profile 39 is designed. Using this, the cam profile portion 46 from the point 45 of the cam profile 38 to the upper dwell 44 is produced.

Figure 12:
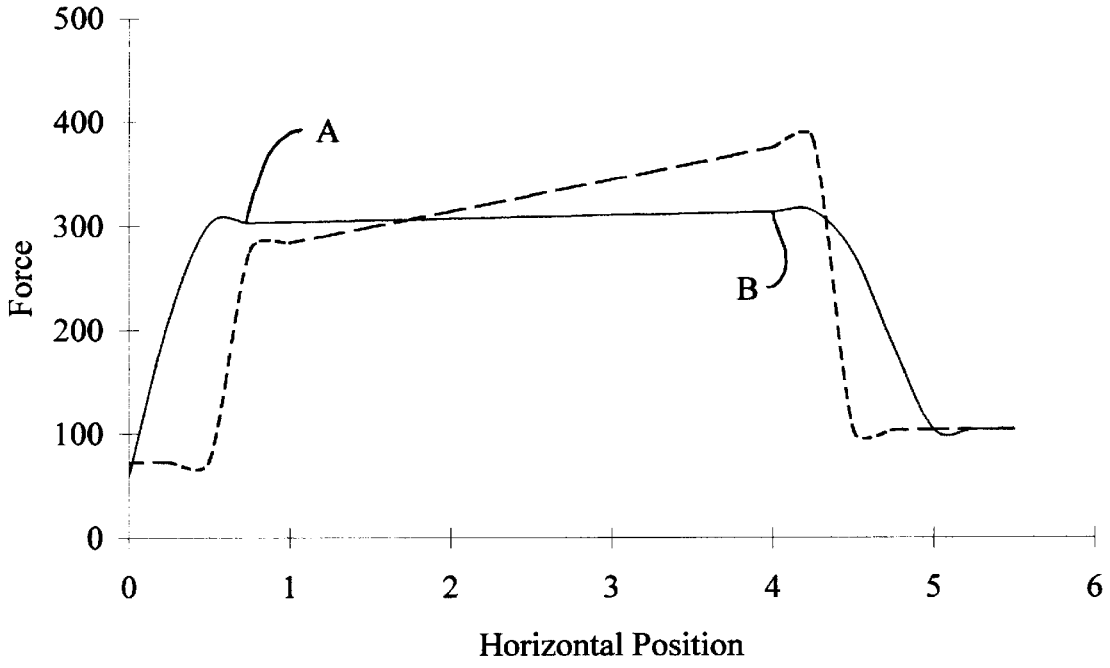
FIG. 12 is a graph of the force created by the cam profile formed by the quadratic equation of the present invention in comparison with the force created by a straight line cam profile.

In the graph of FIG. 12, the substantially constant force of a solid curve from point A to point B is the operating force of the movable sled 22 (see FIG. 1) produced by the quadratic profile portion 46 (see FIG. 11) of the cam profile 38. In FIG. 12, the 0 position corresponds to the point 45 (FIG. 11) of the cam profile 38. The portion of the solid curve in FIG. 12 between the point 0 and the point A defines a cycloidal transition to the quadratic profile portion 46 (see FIG. 11) from the trapezoidal profile portion 43. The portion of the solid curve of FIG. 12 between the point B and position 5 is the cycloidal transition to the upper dwell 44 (see FIG. 11) at the position 5 in FIG. 12. The dash line curve shows the varying force created if the quadratic profile portion 46 were a trapezoid rather than a quadratic.

The operating force for moving a movable sled of a maintenance or service station along a straight line profile is in the range of 400 grams force. The design of the uppermost portion of the cam profile 38 (see FIG. 11) by the quadratic equation lowers this force to 300 grams force. Accordingly, this is a reduction in force of at least 25%. This is a significant reduction in the required maximum power needed by the motor, which drives the carrier 14 (see FIG. 1), to move the movable sled 22 to its uppermost position.

When printing is completed by the ink jet printer 10, the carrier 14 is automatically moved by a controller (not shown) of the ink jet printer 10. The controller is a device which can be programmed to move the carrier 14 through a predetermined maintenance routine after printing is completed.

Accordingly, when the ink jet printer 10 is in a mode of operation in which a predetermined maintenance routine is to be employed, the movable sled 22 is moved in a programmed vertical and longitudinal movement. Therefore, the single drive motor for the carrier 14 may be used to direct operations of the ink jet printer 10 in its normal print of operation and in any maintenance mode of operation.

Figure 5:
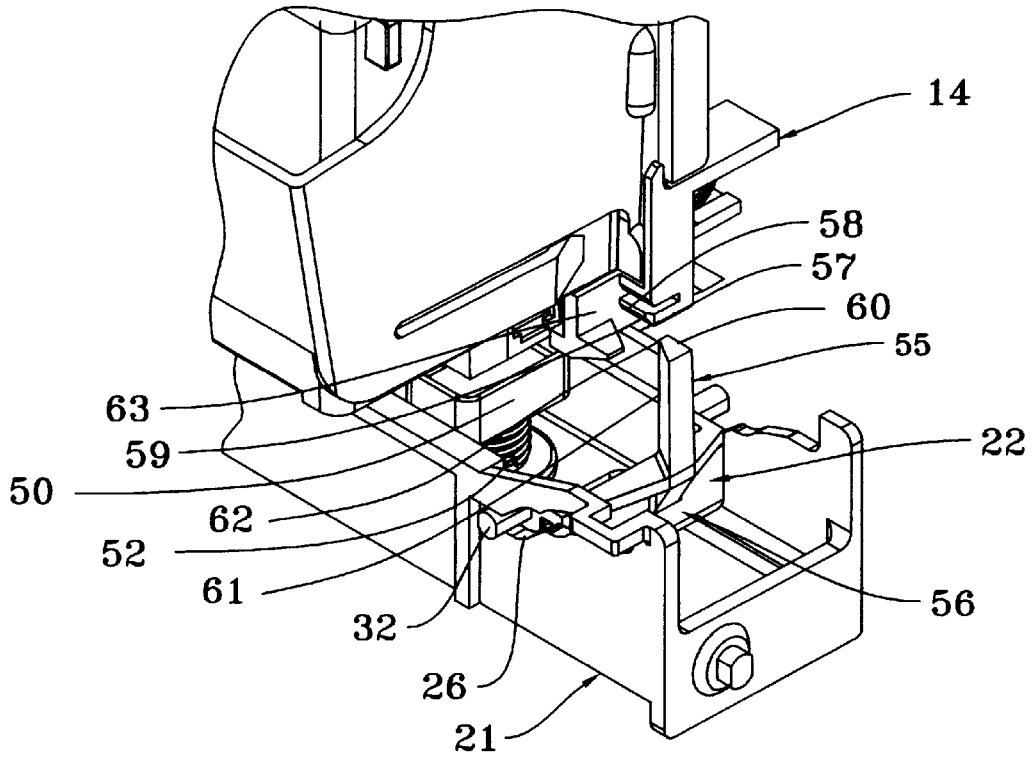
FIG. 5 is a fragmentary perspective view of portions of the carrier, the support housing, and the movable sled just prior to the carrier engaging the movable sled to advance the movable sled from its lowermost position in the support housing.

When the carrier 14 completes a printing cycle on the sheet 18 of paper media, the carrier 14 is moved to the right by the carrier controller of the ink jet printer 10. During movement of the carrier 14 to the right in FIG. 1, an upstanding post 55 (see FIG. 5), which is mounted on a rightmost wall 56 of the sled 22, is engaged by the carrier 14 to begin movement of the movable sled 22 to the right.

The post 55 enters a slot 57, which is defined by a straight surface 58 and an angled surface 59 on the carrier 14. The post 55 has a straight surface 60 and an angled surface 61, which is at the same angle as the angled surface 59. Therefore, the post 55 is guided into the slot 57 so that its left vertical surface 62 engages a vertical surface 63 at the end of the slot 57.

Figure 3:
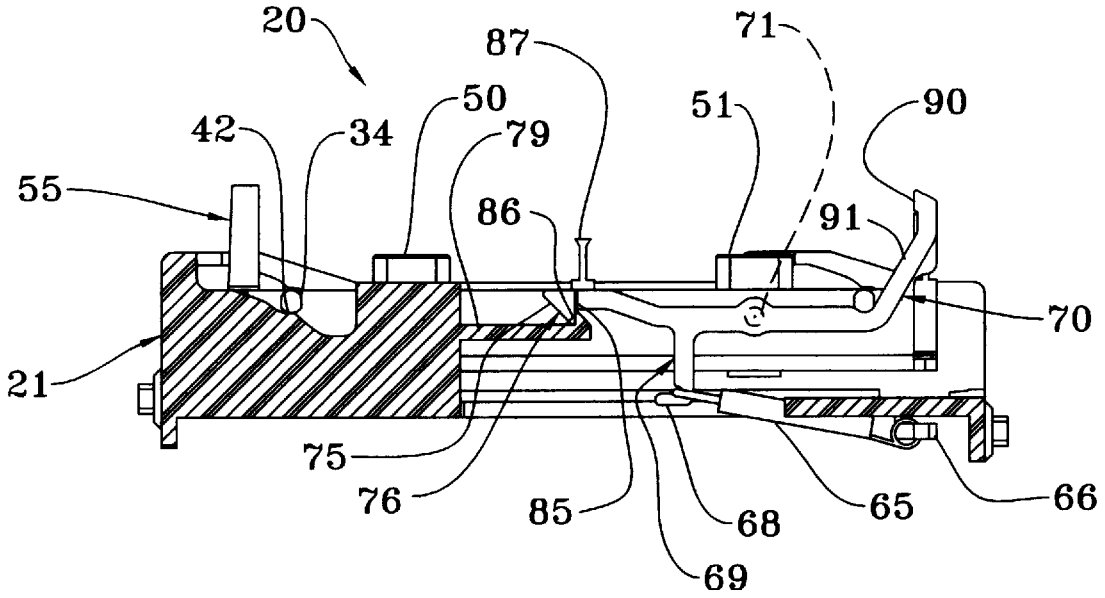
FIG. 3 is a rear sectional view, partly in elevation, of a support housing of the maintenance station having a movable sled supported therein with the movable sled retained in its intermediate or wiping position by a pivotally mounted latch.

The movable sled 22 is continuously urged towards the left in FIG. 1 by a spring 65 (see FIG. 3). One end of the spring 65 is attached to a hook 66 extending downwardly from a bottom surface 67 (see FIG. 4) of the front wall 24 of the support housing 21. The other end of the spring 65 is connected to a hook 68 at the lower end of a leg 69 (see FIG. 3) of a pivotally mounted latch 70.

Figure 6:
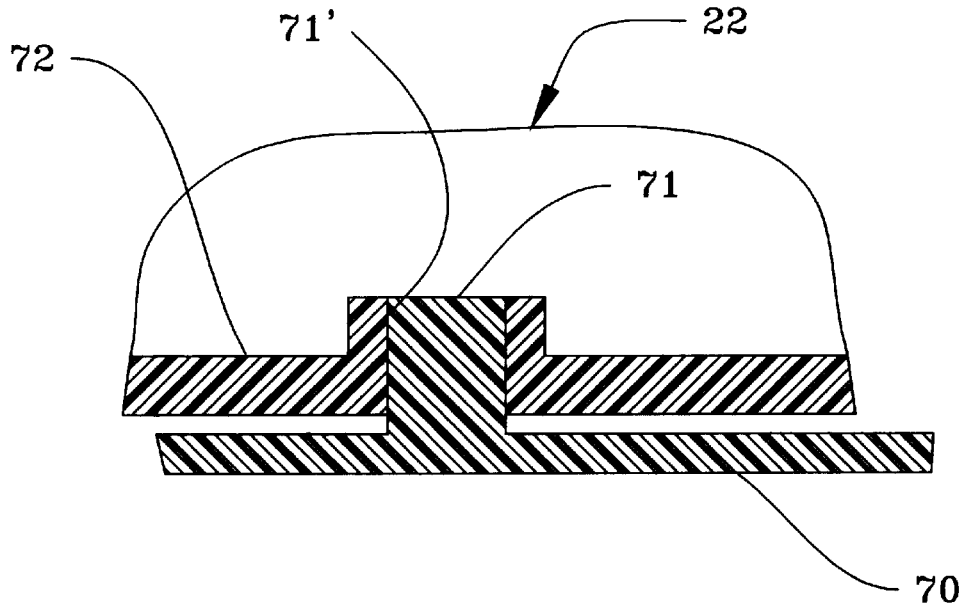
FIG. 6 is a fragmentary sectional view of a pivot mount for pivotally mounting the latch on the movable sled.

The latch 70 (see FIG. 6) is pivotally mounted to the movable sled 22. A pivot post 71 extends from the latch 70 into a hole 71' in a rear wall 72 of the movable sled 22.

Figure 4:
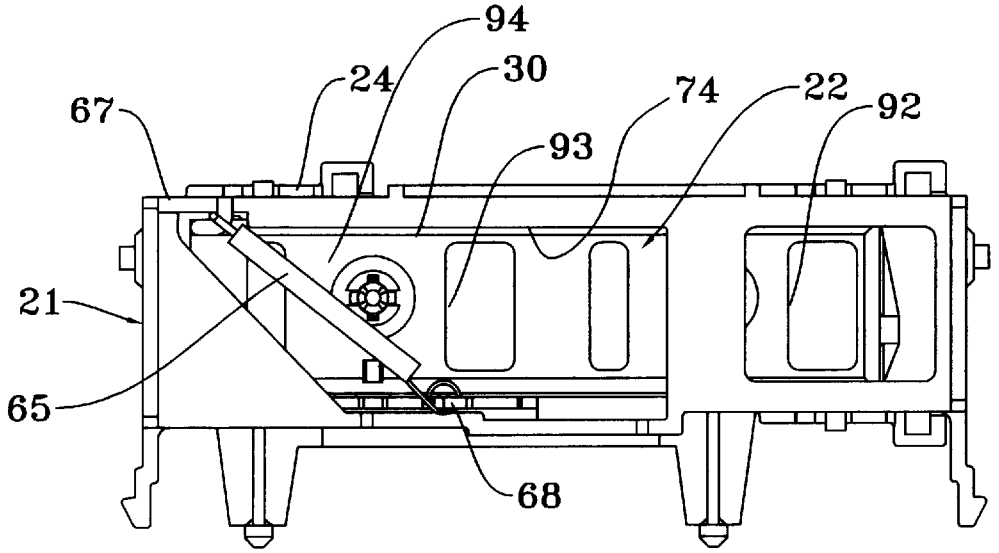
FIG. 4 is a bottom plan view of the movable sled and its support housing with the movable sled in its intermediate or wiping position.

As shown in FIG. 4, the spring 65 is disposed at an angle to the direction of longitudinal movement of the movable sled 22. Accordingly, one component of the force exerted by the spring 65 continuously urges the movable sled 22 longitudinally to its lowermost position. The other component of the force of the spring 65 continuously urges the front wall 30 of the sled 22 against the front wall 24 of the support housing 21.

The carrier 14 (see FIG. 1) starts to move the movable sled 22 to the right through engagement of the vertical surface 63 (see FIG. 5) on the carrier 14 with the vertical surface 62 of the post 55 on the movable sled 22. Just prior to this engagement occurring, the angled surface 61 on the post 55 rides along the angled surface 59 of the carrier 14 to move the vertical surface 60 into engagement with the vertical surface 58 to move the right (left in FIG. 4 because this view is taken from the rear of the printer 10 so that movements are in the opposite direction to FIG. 1) portion of the front wall 30 (see FIG. 4) of the movable sled 22 away from the inner surface 74 of the front wall 24 of the housing 21. This results in the force of the spring 65 being picked up by movable sled 22.

This prevents the biasing force of the spring 65 from urging the left (right in FIG. 1) portion of the front wall 30 of the movable sled 22 against an inner surface 74 of the front wall 24 of the support housing 21. Thus, there is a very small drag on the movable sled 22 because of the right (left in FIG. 1) portion of the movable sled 22 still engaging with the inner surface 74 of the front wall 24 of the support housing 21. It should be understood that the movable sled 22 began from a known fixed home position rather than an unknown home position as would occur if there were a clearance between the front wall 30 of the movable sled 22 and the inner surface 74 of the front wall 24 of the support housing 21.

As the movable sled 22 (see FIG. 1) is moved to the right by the carrier 14, the pins 31, 32, 34 (see FIG. 2), and 35 begin to move up from the low dwell 40 (see FIG. 11) of the cam profile 38 to the upper dwell 44.

As the movable sled 22 (see FIG. 1) is moved from its lowermost position by longitudinal movement of the carrier 14 to the right, the latch 70 (see FIG. 7) is advanced to the left (This is because this view is taken from the rear of the carrier 14 so that movements are in the opposite direction to FIG. 1) so that an angled surface 75 on a pawl 76 at the end of an arm 77 of the latch 70 engages an angled surface 78 of an arm 79 on the support housing 21. Thus, the latch 70 moves over the angled surface 78 of the arm 79 to the position of FIG. 8. This is when the movable sled 22 is in its uppermost position as shown by the pin 34 on the back wall 27 of the movable sled 22 resting on the upper dwell 44.

Figure 9:
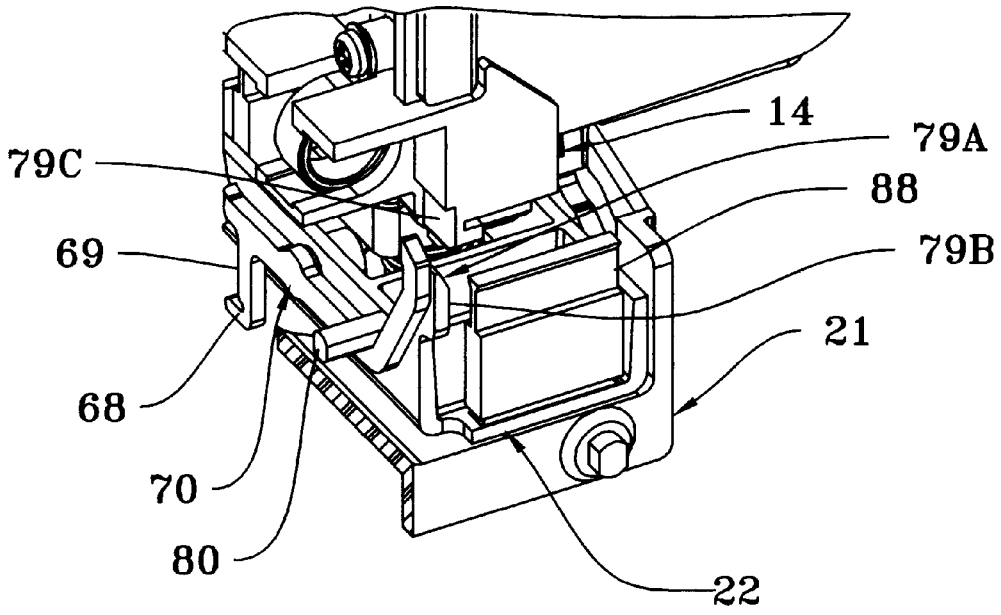
FIG. 9 is a fragmentary perspective view of portions of the support housing, the movable sled, and the carrier taken from the left side in which the left portion of the movable sled is moved relative to the support housing to provide clearance of the left portion of the front wall of the movable sled from the left portion of the front wall of the support housing.

Just after the movable sled 22 is moved upwardly past the intermediate dwell 42 (see FIG. 11), an angled surface 79A (see FIG. 9) on a post 79B, which is fixed to the movable sled 22 and is adjacent the latch 70, is raised sufficiently to engage a vertical surface 79C on the carrier 14. This moves the right (as viewed in FIG. 4) or left (as viewed in FIG. 1) portion of the movable sled 22 away from the inner surface 74 (see FIG. 4) of the front wall 24 of the support housing 21 to provide a clearance between the entire front wall 30 of the movable sled 22 and the inner surface 74 of the front wall 24 of the support housing 21 as shown in FIG. 4.

Figure 7:
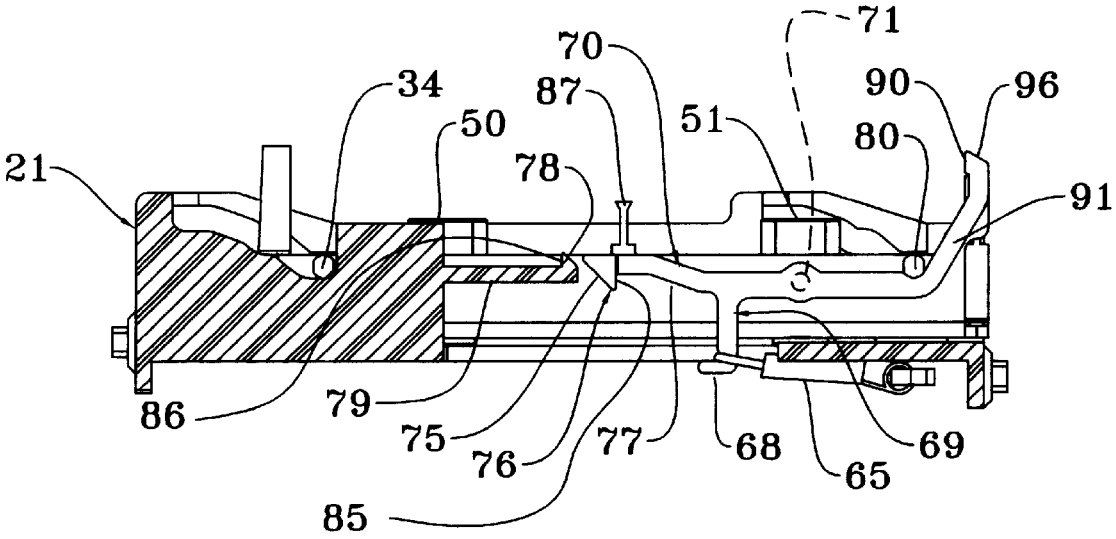
FIG. 7 is a sectional view, partly in elevation, similar to FIG. 3 but with the movable sled in its lowermost or home position.

The latch 70 (see FIG. 7) is biased against a stop pin 80 extending from the rear wall 72 (see FIG. 6) of the movable sled 22 by the spring 65 (see FIG. 7). When the angled surface 75 of the pawl 76 of the latch 70 moves against the angled surface 78 of the arm 79, it was retained there against by the force of the spring 65 because of the stop pin 80 engaging the latch 70 until the movable sled 22 moved upwardly towards its uppermost position of FIG. 8.

Figure 8:
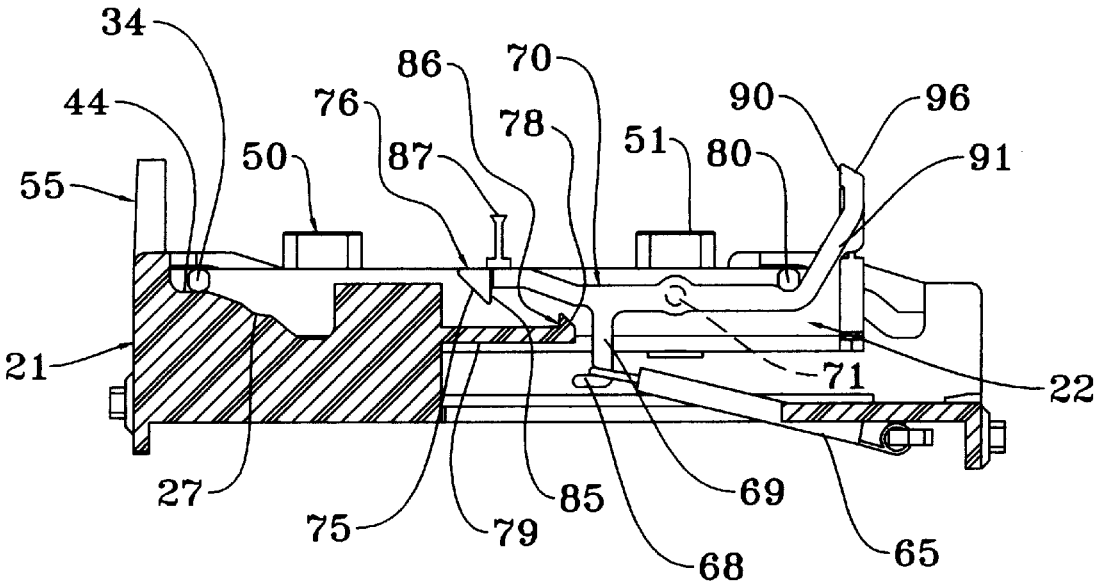
FIG. 8 is a sectional view, partly in elevation, similar to FIG. 3 but with the movable sled in its uppermost or capping position.

Accordingly, when the movable sled 22 is in its uppermost position as shown in FIG. 8, the compression caps 50 and 51 are held in their sealing relation with the print heads of the ink cartridges 11 (see FIG. 1) and 12, respectively. This prevents evaporation of ink from the print heads of the ink jet printer 10.

When the controller of the ink jet printer 10 returns the carrier 14 to cooperate with the sheets 18 of paper media to again print thereon, the direction of the motor is reversed to move the carrier 14 to the left in FIG. 1. As the carrier 14 moves to the left in FIG. 1, the spring 65 (see FIG. 3) causes the movable sled 22 to follow the motion of the carrier 14 (see FIG. 1). The movable sled 22 is moving to the left in FIG. 1 but to the right in FIG. 3. When the movable sled 22 reaches the position of FIG. 3 in which the pin 34, for example, rests on the intermediate dwell 42 through movement of the movable sled 22 to the right in FIG. 3, a vertical surface 85 of the pawl 76 engages a vertical surface 86 on the arm 79 to stop movement of the movable sled 22.

Continued motion of the carrier 14 to the left in FIG. 1 towards the sheets 18 of paper media at which printing occurs results in the print heads on the ink cartridges 11 and 12 engaging wipers 87 and 88, respectively. The wipers 87 and 88 are mounted on the movable sled 22 and extend above the tops of the caps 50 and 51.

With the movable sled 22 in its intermediate position in which the pins or cam followers 31, 32, 34 (see FIG. 2), and 35 are disposed on the intermediate flat dwell 42 (see FIG. 11) of the cam profile 38, the wipers 87 (see FIG. 1) and 88 extend upwardly sufficiently to engage the print heads on the ink cartridges 11 and 12, respectively. The wipers 87 and 88 have sufficient engagement with the print heads on the ink cartridges 11 and 12, respectively, to wipe any excess ink from the nozzles forming the print head on each of the ink cartridges 11 and 12.

After wiping is completed, the carrier 14 moves further to the left in FIG. 1 (In FIGS. 2 and 3, the carrier 14 is moving to the right when it returns toward the print area) to cause a vertical surface 89 (see FIG. 2) on the back of the carrier 14 to engage a vertical surface 90 (see FIG. 3) on the upper end of a leg 91 of the latch 70. Thus, engagement of the vertical surface 89 (see FIG. 2) on the carrier 14 with the vertical surface 90 (see FIG. 3) on the upper end of a leg 91 of the latch 70 causes the latch 70 to pivot clockwise about the pivot post 71 against the force of the return spring 65 to remove the vertical surface 85 of the pawl 76 from engagement with the vertical surface 86 on the arm 79. This delatching or releasing of the latch 70 enables the spring 65 to move the movable sled 22 to the right in FIGS. 2 and 3 (This is to the left in FIG. 1.) to its lowermost position.

When the latch 70 is released, the spring 65 (see FIG. 4) moves the front wall 30 of the movable sled 22 against the inner surface 74 of the front wall 24 of the support housing 21. The friction of this engagement and damping by a viscous media such as grease, for example, on the inner surface 74 of the front wall 24 of the support housing 21 slow the downward movement of the movable sled 22 to its lowermost position. This absorbs energy of the force of the left (as viewed in FIG. 1) end of the movable sled 22 engaging the left end of the support housing 21. This reduces the noise level of the ink jet printer 10 (see FIG. 1).

The controller of the ink jet printer 10 causes motion of the carrier 14 to the right to align the print heads (not shown) on the cartridges 11 and 12 with rectangular shaped openings 92 (see FIG. 4) and 93, respectively, in a bottom wall 94 of the movable sled 22. Each of the openings 92 and 93 enables ejection of ink from each of the nozzles in the print heads of the ink cartridges 11 (see FIG. 1) and 12 to clear the nozzles. The ink passes through the openings 92 (see FIG. 4) and 93 into ink collection areas in the bottom of the ink jet printer 10 (see FIG. 1).

After ink is ejected to clear the nozzles, the controller of the ink jet printer 10 causes the carrier 14 (see FIG. 1) to be moved to the left to return it for cooperation with the sheets 18 of paper media and the movable sled 22 has been returned to its lowermost position by the return spring 65 (see FIG. 3), the controller of the ink jet printer 10 determines when there should be wiping of the print heads on the cartridges 11 and 12 and ejection of ink from the nozzles. This occurs after a certain amount of a print cycle has been completed but not all of the print cycle.

When this wiping and ejection of ink from the nozzles is to occur before the print cycle is completed and the print cycle could be completed before it is to occur, the carrier 14 again is moved to the right in FIG. 1 to move the movable sled 22 to its intermediate position. This is the position in which the intermediate dwell 42 (see FIG. 11) of the cam profile 38 has the pins 31 (see FIG. 1), 32, 34 (see FIG. 2), and 35 resting thereon.

With the movable sled 22 (see FIG. 3) in its intermediate position, the latch 70 is again latched. Then, the carrier 14 (see FIG. 1) is moved to the left in FIG. 1 to move over the wipers 87 and 88, which engage the print heads on the ink cartridges 11 and 12, respectively.

Continued movement to the left in FIG. 1 of the carrier 14 causes release of the latch 70 as previously discussed.

Thereafter, the carrier 14 is again moved to the right after the movable sled 22 is in its lowermost position to eject ink from the nozzles and through the rectangular shaped openings 92 (see FIG. 4) and 93 in the bottom wall 94 of the movable sled 22 into the collection area.

Figure 10:
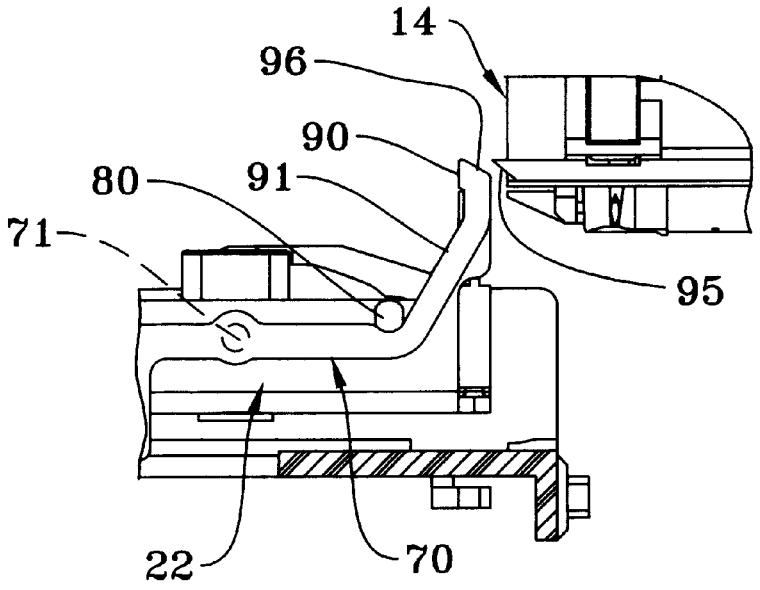
FIG. 10 is a fragmentary perspective view of portions of the movable sled, the support housing, and the carrier and showing the movable sled inadvertently disposed in its intermediate or wiping position in the support housing with the carrier having a surface to enable return of the movable sled to its lowermost position in the support housing.

If the movable sled 22 should be inadvertently moved upwardly to its intermediate position when the carrier 14 (see FIG. 1) is over the sheets 18 of paper media such as by jarring or a paper jam, for example, then the movable sled 22 could cause jamming with the carrier 14 when the carrier 14 is moved to the right in FIG. 1 (left in FIG. 10). To prevent this, the carrier 14 has an angled surface 95 (see FIG. 10) on its left (right in FIG. 1) end for engagement with an angled surface 96 on the upper end of the leg 91 of the latch 70. The engagement of the angled surface 95 with the angled surface 96 causes clockwise pivoting of the latch 70 about the pivot post 71 against the force of the return spring 65 (see FIG. 3) to delatch or release the latch 70 (see FIG. 10). This delatching or releasing of the latch 70 enables the latch 70 to return to its lowermost position by the force of the return spring 65 (see FIG. 3).

The pins 31 (see FIG. 1), 32, 34 (see FIG. 2), and 35 have been shown and described as being on the movable sled 22 and the cam slot 25 (see FIG. 1), the cam slot 26, the cam slot 28 (see FIG. 2), and the cam surface 29 on the support housing 21. However, it should be understood that this arrangement could be reversed so that the pins 31 (see FIG. 1), 32, 34 (see FIG. 2), and 35 are on the movable sled 22 and the cam slot 25 (see FIG. 1), the cam slot 26, the cam slot 28 (see FIG. 2), and the cam surface 29 are on the support housing 21. It is only necessary for them to cooperate with each other.

The location of the latch 70 (see FIG. 1) towards the rear so that the latch 70 is behind the plane of the print heads of the ink cartridges 11 and 12 enables use with different designs of the ink cartridges 11 and 12 without having to change the location of the latch 70. For example, the print heads may be made wider or longer without the position of the latch 70 having to be changed. Of course, the sizes of the support housing 21, the movable sled 22, the caps 50 and 51, and the wipers 87 and 88 would have to be changed.

Figure 13:
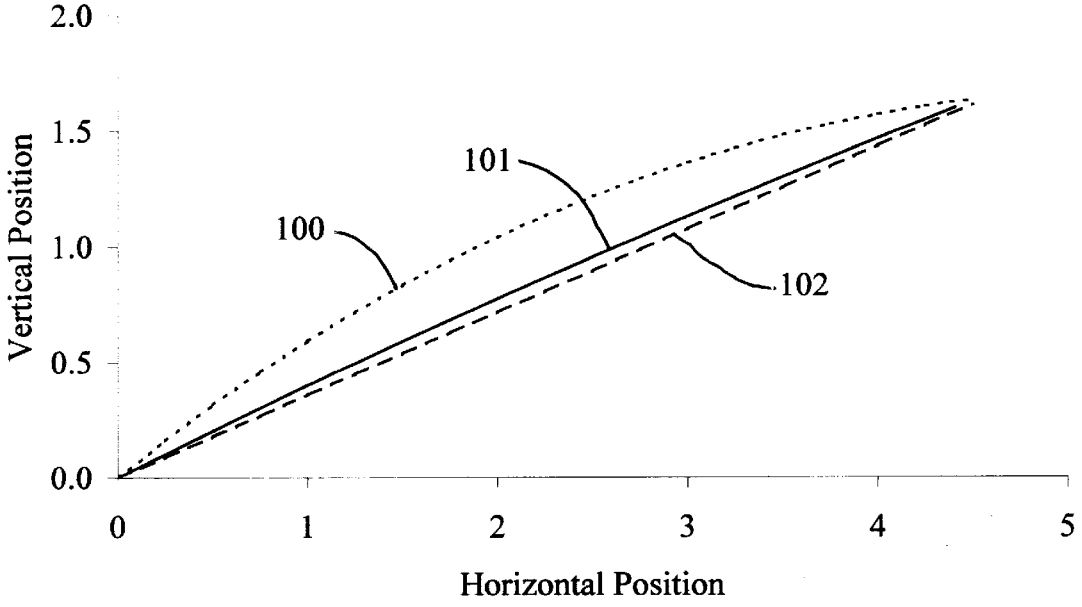
FIG. 13 is a schematic diagram showing shapes of cycloidal, quadratic, and trapezoidal cam profiles.

In FIG. 13, the shape of a curve 100 represents a cycloidal cam profile. The shape of a curve 101 is for a cam profile produced from a quadratic equation. The shape of a curve 102 is for a trapezoidal cam profile.

An advantage of this invention is that it requires less power than presently available maintenance or service stations. Another advantage of this invention is that it provides a more flexible maintenance station for a ink jet printer in that it accommodates different designs of ink jet cartridges. A further advantage of this invention is that it reduces the cost of the printer because a smaller motor may be utilized due to decreased power requirements. Still another advantage of this invention is that the noise level produced by the printer is decreased when the movable sled returns to its lowermost or home position.

For purposes of exemplification, a preferred embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A maintenance station for a printer having a movable bidirectional carrier and printing means mounted thereon including:

a fixed support housing;

a movable sled supported on said support housing for longitudinal movement relative thereto in opposite directions;

cam means on said movable sled and said support housing cooperating with each other to cause said movable sled to move vertically in response to the longitudinal movement of said movable sled relative to said support housing in a first longitudinal directions said cam means including:

a plurality of cam surfaces on one of said movable sled and said support housing; and a plurality of cam followers on the other of said movable sled and said support housing, each of said cam followers cooperating with one of said cam surfaces;

first means supported by said movable sled for providing maintenance on a first area of the printing means in which said movable sled is subjected to a first sled operating force, applied thereto by movement of the carrier to move said movable sled, due to engagement of said first means with the first area of the printing means;

second means supported by said movable sled for providing maintenance on the printing means in which said movable sled is subjected to a second sled operating force, applied thereto by movement of the carrier to move said movable sled, due to engagement of said second means with a second area of the printing means, the second sled operating force being greater than the first sled operating force, wherein each of said cam surfaces has a cam profile designed to maintain the second sled operating force substantially constant during upward movement of said movable sled, said cam profile of each of said cam surfaces being designed in accordance with a quadratic equation to enable application of a minimum and substantially constant second sled one rating force from the carrier to said movable sled for longitudinal movement thereof;

resilient means acting between said movable sled and said support housing to continuously urge said movable sled in a second longitudinal direction opposite to the first direction in which said movable sled is moved by movement of the carrier, said resilient means including a spring having a second end fixed to said support housing and a first end fixed to said movable sled, in which said spring exerts a force at an angle to the longitudinal movement of said movable sled so as to apply a force continuously urging said movable sled in a direction perpendicular to the longitudinal movement of said sled to a predetermined position in addition to continuously urging said movable sled in the second longitudinal direction; and cooperating means on said movable sled and said support housing for holding said movable sled in a fixed position when said first means is providing maintenance in the first area of the printing means, said cooperating means including:

holding means on said support housing;

a latch pivotally mounted on said movable sled and engaging said holding means on said support housing;

and said first end of said spring fixed to said latch to also urge said latch into engagement with said holding means on said support housing.

2. A maintenance station for a printer having a movable bidirectional carrier and printing means mounted thereon including:

a fixed support housing;

a movable sled supported on said support housing for longitudinal movement relative thereto in opposite directions;

cam means on said movable sled and said support housing cooperating with each other to cause said movable sled to move vertically in response to the longitudinal movement of said movable sled relative to said support housing in a first longitudinal direction;

a spring having a second end fixed to said support housing and a first end fixed to said movable sled to continuously urge said movable sled in a second longitudinal direction opposite to the first longitudinal direction in which said movable sled is moved by movement of the carrier;

said spring exerting a force at an angle to the longitudinal movement of said movable sled to apply a first force to said movable sled in the second longitudinal direction and to apply a second force continuously urging said movable sled perpendicular to, and in the same plane as, the longitudinal movement of said movable sled to a predetermined position;

means responsive to movement of said movable sled in the first longitudinal direction for moving said movable sled away from the predetermined position; and cooperating means on said movable sled and said support housing for holding said movable sled in a fixed position when a first means is providing maintenance in a first area of the printing means, wherein said cooperating means includes:

holding means on said support housing;

a latch pivotally mounted on said movable sled and engaging said holding means on said support housing;

and said first end of said spring fixed to said latch to also urge said latch into engagement with said holding means on said support housing.

3. A maintenance station for a printer having a movable bidirectional carrier and printing means mounted thereon including:

a fixed support housing;

a movable sled supported on said support housing for longitudinal movement relative thereto in opposite directions;

cam means on said movable sled and said support housing cooperating with each other to cause said movable sled to move vertically in response to the longitudinal movement of said movable sled relative to said support housing in a first longitudinal direction;

a spring having a second end fixed to said support housing and a first end fixed to said movable sled to continuously urge said movable sled in a second longitudinal direction opposite to the first longitudinal direction in which said movable sled is moved by movement of the carrier;

said spring exerting a force at an angle to the longitudinal movement of said movable sled to apply a first force to said movable sled in the second longitudinal direction and to apply a second force continuously urging said movable sled perpendicular to, and in the same plane as, the longitudinal movement of said movable sled to a predetermined position; and cooperating means on said movable sled and said support housing for holding said movable sled in a fixed position when a first means is providing maintenance in a first area of the printing means, wherein said cooperating means includes:

holding means on said support housing;

a latch pivotally mounted on said movable sled and engaging said holding means on said support housing;

and said first end of said spring fixed to said latch to also urge said latch into engagement with said holding means on said support housing.

4. A maintenance station for a printer having a movable bidirectional carrier and printing means mounted thereon including:

a fixed support housing;

a movable sled supported on said support housing for longitudinal movement relative thereto in opposite directions;

cam means on said movable sled and said support housing cooperating with each other to cause said movable sled to move vertically in response to the longitudinal movement of said movable sled relative to said support housing in a first longitudinal direction, said cam means including:

a plurality of cam surfaces on one of said movable sled and said support housing; and a plurality of cam followers on the other of said movable sled and said support housing, each of said cam followers cooperating with one of said cam surfaces;

first means supported by said movable sled for providing maintenance on a first area of the printing means in which said movable sled is subjected to a first sled operating force, applied thereto by movement of the carrier to move said movable sled, due to engagement of said first means with the first area of the printing means;

second means supported by said movable sled for providing maintenance on the printing means in which said movable sled is subjected to a second sled operating force, applied thereto by movement of the carrier to move said movable sled, due to engagement of said second means with a second area of the printing means, the second sled operating force being greater than the first sled operating force, wherein each of said cam surfaces has a cam profile designed to maintain the second sled operating force substantially constant during upward movement of said movable sled;

resilient means including a spring acting between said movable sled and said support housing to continuously urge said movable sled in a second longitudinal direction opposite to the first direction in which said movable sled is moved by movement of the carrier; and cooperating means on said movable sled and said support housing for holding said movable sled in a fixed position when said first means is providing maintenance in the first area of the printing means, said cooperating means including:

holding means on said support housing;

a latch pivotally mounted on said movable sled and engaging said holding means on said support housing;

and a first end of said spring fixed to said latch to also urge said latch into engagement with said holding means on said support housing.

* * * * *